US005704603A

United States Patent [19]

Nalecz et al.

[11] Patent Number: 5,704,603

[45] Date of Patent: Jan. 6, 1998

[54] CLOTH SPREADING MACHINE HAVING IMPROVED CLOTH FEED CONTROL AND GUIDE

[75] Inventors: Andrew A. Nalecz, Williamsville; Robert M. Yetman, Lakeview, both of N.Y.

[73] Assignee: Eastman Machine Company, Buffalo, N.Y.

[21] Appl. No.: 530,879

[22] Filed: Sep. 20, 1995

[51] Int. Cl.[6] ..... B65H 29/46

[52] U.S. Cl. ..... 270/30.03; 270/30.04; 242/420.3; 242/557

[58] Field of Search ..... 270/30.03, 30.04, 270/30.12, 30.13; 242/557, 420.3; 28/101; 26/51.5, 74, 99

[56] References Cited

U.S. PATENT DOCUMENTS

| | | | |
|---|---|---|---|
| 3,165,311 | 1/1965 | Mitchell | 270/30.13 |
| 3,663,006 | 5/1972 | Benson et al. | 270/30.13 |
| 3,684,273 | 8/1972 | Benson et al. | 270/30.12 |
| 3,735,223 | 5/1973 | Fort et al. | 270/30.13 X |
| 3,755,861 | 9/1973 | Castro et al. | 27/74 |
| 3,782,649 | 1/1974 | Frederick et al. | 270/30.03 |
| 4,339,118 | 7/1982 | Burton et al. | 270/30.12 |
| 4,445,044 | 4/1984 | Buess | 250/599.29 |
| 4,676,494 | 6/1987 | Smith et al. | 270/30.04 |

*Primary Examiner*—John T. Kwon
*Attorney, Agent, or Firm*—Hodgson, Russ, Andrews, Woods & Goodyear LLP

[57] ABSTRACT

In a cloth spreading machine having a motor-driven cradle for holding a roll of cloth and feeding cloth from the roll onto a supporting surface along which the machine travels, a first signal is provided which is proportional to the speed of travel of the machine, a second signal is provided which is proportional to the rate of feed of cloth from the roll, and a control responsive to the first and second signals provides a signal for controlling the speed of the cradle motor so that the rate of feed of cloth from the roll is substantially equal to the speed of travel of the machine along the surface. Sudden changes in tension on the cloth due to acceleration or deceleration of the machine cause movements in a dancer bar which are converted by a transducer to an input to the control for causing a relatively rapid compensating increase or decrease in the speed of the cradle motor. The first and second signals are provided by tachometers associated with the machine and cradle motors, respectively, and the control includes a circuit having one control loop with the dancer bar transducer being in another loop of the control circuit. The circuit also includes a component for providing a fine adjustment in tension on the cloth during feed. The knife box or folding blades of the cloth spreading machine includes a one-piece cloth guide which accommodates raising and lowering of the box or blades in a manner interfacing with flow of cloth along the guide.

17 Claims, 5 Drawing Sheets

CLOTH SPREADING MACHINE HAVING IMPROVED CLOTH FEED CONTROL AND GUIDE

BACKGROUND OF THE INVENTION

This invention relates to the art of cloth spreading machines, and more particularly to a new and improved cloth feed control and guide for such machines.

Cloth spreading means for feeding cloth from a roll for spreading onto a cloth cutting table include, briefly, a motor-driven frame which moves longitudinally back and forth along the table and which frame carries a relatively large and heavy roll of cloth, together with suitable means for feeding the cloth from the roll and guiding it onto the surface. Layers or plies of cloth are built-up on the surface of the table as the machine moves back and forth, and usually a knife arrangement on the machine cuts the cloth at selected intervals.

In one form of cloth spreading machine the large, heavy substantially cylindrical roll of cloth is supported by a pair of spaced-apart upright arms on the machine frame which receive the ends of a mandrel inserted centrally through the roll of cloth. Typically, the roll of cloth is first held by a fork-lift and guided into position between the arms with manual assistance to engage the mandrel ends into the arm and release the roll from the forklift. The cloth roll is freely rotatably supported on the upright arms, and cloth is drawn or pulled from the roll during operation of the machine by rollers between which the cloth is fed. Examples of this type of cloth spreading machine are found in U.S. Pat. No. 4,728,089 issued Mar. 1, 1988 and U.S. Pat. No. 5,018,713 issued May 28, 1991, the disclosures of both of which are hereby incorporated by reference.

In a more recent form of cloth cutting machine the roll of cloth is held in a cradle on the machine frame which is in the general form of a V-shaped trough extending laterally relative to the direction of travel of the machine along the cutting table. The cradle includes a plurality of motor-driven belts at spaced locations laterally of the machine, each belt moving in a direction along a plane parallel to the direction of travel of the machine. The belts are arranged to define the V-shaped trough for holding the roll of cloth, and the moving belts contact the cloth to unwind it from the roll and feed it toward the surface of the cutting table as the machine moves therealong.

The cradle form of cloth spreading machine has the advantage that the large, heavy roll of cloth simply can be unloaded from a fork-lift or the like into the V-shaped trough defined by the cradle. There is no need to insert a mandrel through the roll, and no need to align the ends of the mandrel with receptacles in upright arms on the machine frame. Thus, installation of a cloth roll into the spreading machine is relatively quick, easy and safe. Furthermore, the cradle form of cloth spreading machine provides a relatively tension-free delivery or feed of cloth from the roll to the surface of the cutting table. This is due to the action of the moving belts which contact the cloth to rotate the roll and unwind the cloth therefrom, in contrast to pulling or drawing the cloth to unwind it from the roll. Also, the cradle accommodates rolls having out-of-round cross-sections to provide a steady and constant feed rather than a pulsating or irregular feed which could arise from a rotatably mounted out-of-round shaped roll.

In either form of cloth spreading machine, it is necessary to control the rate at which cloth is unwound from the roll and is fed to the cutting table relative to the speed of travel of the machine along the table. If the cloth unwinding rate exceeds the machine speed, unwanted slack will develop in the cloth. If the cloth unwinding rate falls behind the machine speed, tension develops in the cloth which is undesirable for some fabrics. Whatever control is provided for unwinding the cloth also should accommodate acceleration and deceleration of the cloth spreading machine as it moves along the table. There should also be some way of introducing a small amount of tension during unwinding if the nature of the cloth requires it.

Cloth spreading machines of the foregoing types are provided with a cloth engaging means such as a knife box structure or folding blade arrangement supported on the machine frame, extending laterally relative to the direction of travel of the machine, and raised by an elevator arrangement on the frame to accommodate build-up of the cloth plies or layers. Cloth must be guided as it leaves the roll and enters the knife box or folding blades in a manner which accommodates the raising and lowering of the same.

SUMMARY OF THE INVENTION

It would, therefore, be highly desirable to provide, in a spreading machine having a cradle for supporting and feeding a roll of cloth, synchronization of the cloth feed rate provided by the cradle with the speed of the machine along a surface so that unwinding of cloth from the roll is at substantially the same rate as the rate of travel of the machine along the surface. It would be desirable also to provide such synchronization in a manner accommodating acceleration and deceleration in the travel of the machine and in a manner enabling some tension to be introduced to the fabric during unwinding if desired. Cloth should be guided to the machine knife box or folding blades in a manner which effectively accommodates raising of the knife box or folding blades in response to build-up of plies of cloth on the surface and in a manner which does not interfere with smooth travel of the cloth through the machine.

The present invention provides, in a cloth spreading machine having a motor-driven cradle for holding a roll of cloth and feeding cloth from the roll onto a supporting surface along which the machine travels, means for providing a first signal proportional to the speed of travel of the machine, means for providing a second signal proportional to the rate of feed of cloth from the roll and control means responsive to the first and second signals to provide a signal for controlling the speed of the cradle motor so that the rate of feed of cloth from the roll is substantially equal to the speed of travel of the machine along the surface. Sudden changes in tension on the cloth due to acceleration or deceleration of the machine cause movements in a dancer bar which are converted by a transducer to an input to the control means for causing a relatively rapid compensating increase or decrease in the speed of the cradle motor. The first and second signals are provided by tachometers associated with the machine and cradle motors, respectively, and the control means comprises a circuit having one control loop with the dancer bar transducer being in another loop of the control circuit. The circuit also includes means for providing a fine adjustment in tension on the cloth during feed. The knife box or folding blades of the cloth spreading machine includes a one-piece cloth guide which accommodates rasing and lowering of the same in a manner not interfering with flow of cloth along the guide.

The foregoing and additional advantages and characterizing features of the present invention will become clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENT

Figure 1:
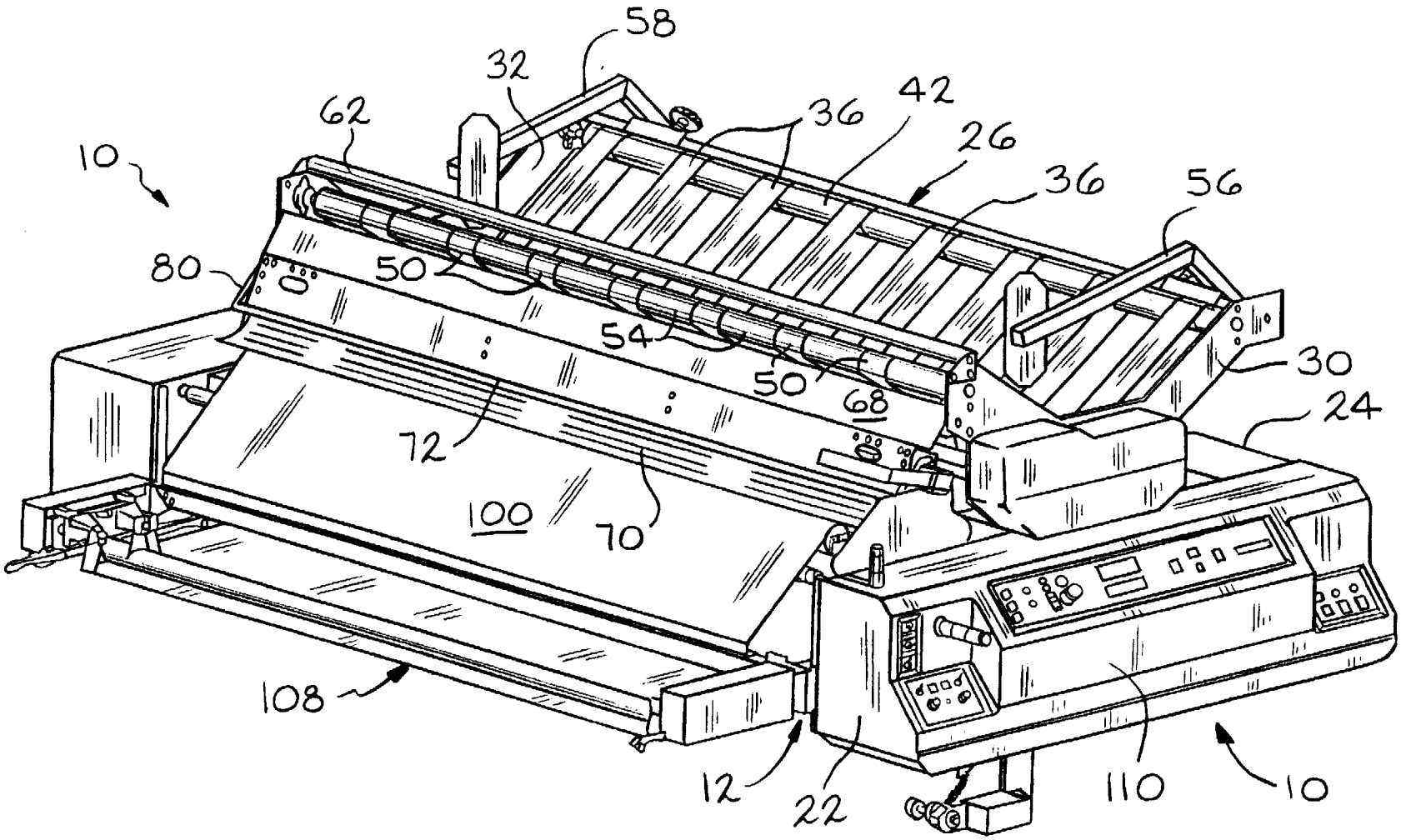
FIG. 1 is a perspective view of a cloth spreading machine including the improved control and cloth guiding features of the present invention.
Figure 2:
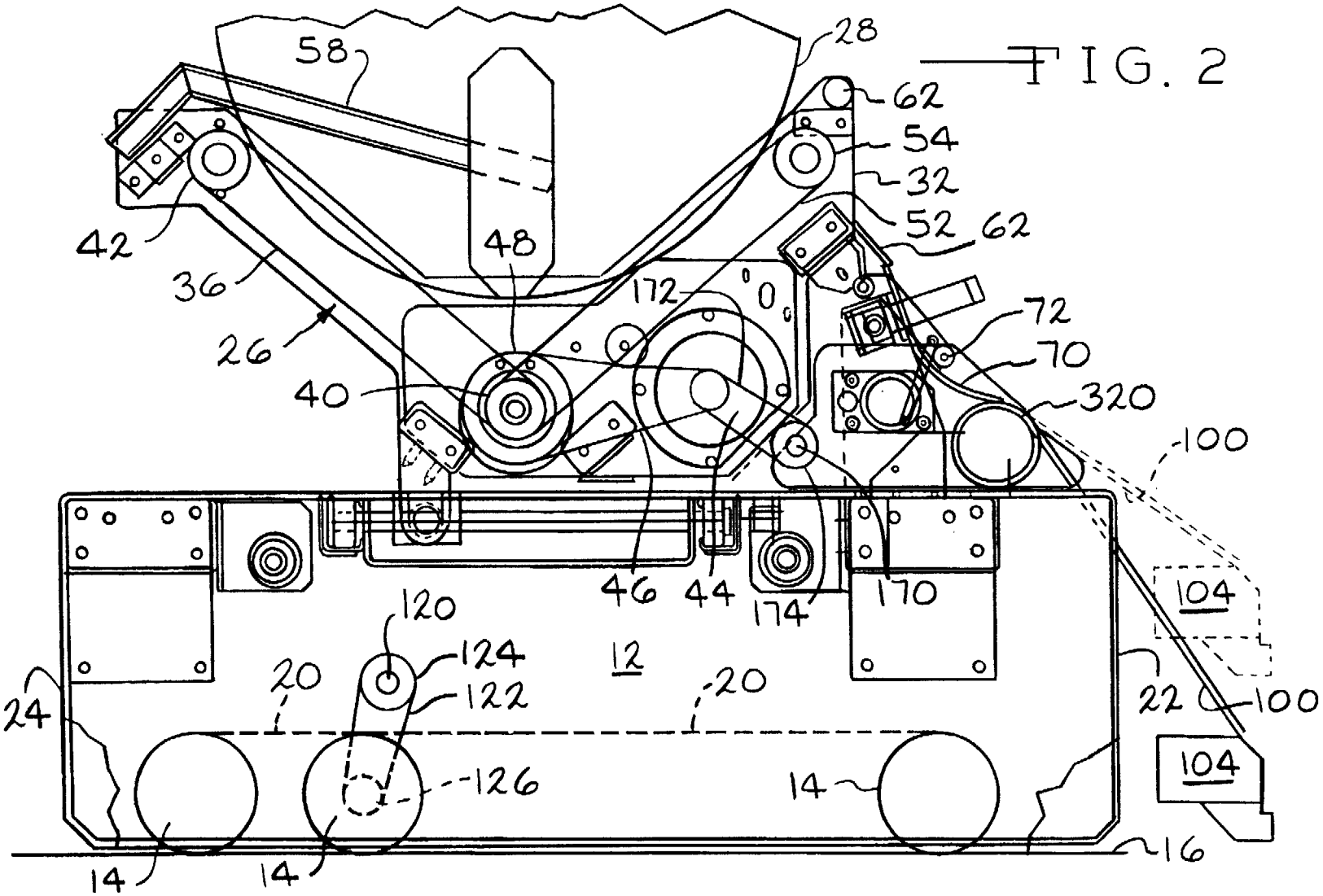
FIG. 2 is a side elevational view, partly diagrammatic, of the cloth spreading machine of FIG. 1.

Referring first to FIGS. 1 and 2 there is shown a cloth spreading machine, generally designated 10, provided with the improved cloth feed control and guide according to the present invention. Machine 10 comprises a frame, generally designated 12, in which a plurality of wheels 14 are rotatably connected, and the wheels 14 are supported on and movable along a surface designated 16 in FIG. 2 which typically is the top surface of a cloth cutting table of the type found in cutting rooms. At least four wheels 14 are provided, one near each of the four corners of the generally rectangular frame 12 and are driven by a chain arrangement, indicated diagrammatically at 20 in FIG. 2, which in turn is driven by an electric motor (not shown) carried by frame 12, all in a manner well-known to those skilled in the art. Wheels 14 typically engage tracks or rails (not shown) extending longitudinally along the top surface 16 of the cutting room table in a known manner. Frame 12 has forward and rear ends 22 and 24, respectively, in relation to the direction of movement of machine 10 along surface 16.

Machine 10 includes a cradle, generally designated 26, supported by frame 12 for holding a roll 28 of cloth or like sheet material and for unwinding the cloth from roll 28 so that the cloth can travel through the remainder of the machine 10 and be spread onto surface 16 in a manner which will be described. Cradle 26 is located on the upper portion of frame 12 as viewed in FIGS. 1 and 2 and is in the form of a V-shaped trough extending laterally of machine frame 12, i.e. in a direction substantially normal to the direction of travel of machine 10 along surface 16 which direction of travel is to the right and left as viewed in FIG. 2. A pair of V-shaped frame members 30 and 32 define the ends of the cradle trough. Cradle 26 includes means for providing moving surfaces in the trough which contact the surface of cloth on roll 28 to unwind the cloth from the roll and feed the cloth to the remainder of the machine 10. In particular, cradle 26 includes a plurality of motor-driven spaced apart belts which define the surfaces of the V-shaped trough whereby during movement of the belts the cloth is unwound from roll 28.

As shown in FIG. 1, a first series of belts 36 is arranged along one of the surfaces of the V-shaped trough, the belts 36 being in spaced apart relation laterally across the machine frame 12 and being disposed in an upwardly inclined direction from the bottom of the trough toward the rear end 24 of the machine frame 12. Belts 36 are trained around a pair of belt shafts or tubes, one of which is a driven shaft or tube 40 rotatably connected to the lower portions of the frame members 30, 32 as shown in FIG. 2 and the other of which is an idler shaft or tube 42 rotatably connected to the upper ends of the arms of frame members 30, 32 extending toward the rear end 24 of machine 10. Shaft 40 is driven by an electric motor 44 carried by frame member 32 as shown in FIG. 2 and drivenly coupled to shaft 40 by means of a chain 46 and sprocket 48. Belts 36 move in directions along planes generally parallel to the direction of movement of machine 10 along surface 16. Similarly, a second series of belts 50 is arranged along the other of the surfaces of the V-shaped trough of cradle 26, the belts 50 being in spaced apart relation laterally across machine frame 12 and being disposed in an upwardly inclined direction from the bottom of the trough toward the forward end 22 of the machine frame. Belts 50 are trained around the driven shaft 40 and an idler tube or shaft 54 rotatably connected to the upper ends of the arms of frame member 30, 32 extending toward the forward end 22 of machine 10. Belts 50 are arranged in alternating or staggered relation to belts 36 and move in directions along planes generally parallel to the direction of movement of machine 10 along surface 16.

Thus, when cloth roll 28 is placed in cradle 26 as shown in FIG. 2, the surfaces of belts 36 and 50 contact the cloth on roll 28. Motor 44 is operated to move belts 36 and 50 both in clockwise directions to rotate roll 28 in a counter-clockwise direction as viewed in FIG. 1 to unwind cloth from roll 28 for feeding to the remainder of machine in a known manner. Cradle 26 can be provided with a pair of cloth alignment arms 56 and 58 at opposite ends of the trough and fixed to cradle frames 30 and 32, respectively, which serve to hold the cloth roll 28 in place as it is unwound.

As cloth leaves roll 28 it initially is guided through a small space between a stationary guide tube 62 fixed at opposite ends to arms of the cradle frames 30, 32 and front idler tube 54 rotatably connected at opposite ends to the frames 30, 32. When roll 28 is nearly completely unwound it is relatively light in weight and there can be a tendency to pull the roll 28 out of cradle 26. This is prevented by the relatively small space between tubes 62, 54 through which the cloth travels. The cloth leaving roll 28 next moves along the surface of a cradle chute 68 and then along the surface of a dancer bar chute 70 and beneath a dancer bar 72 which serves to sense a substantial increase in tension applied to the cloth as it is leaving roll 28. In particular, dancer bar 72 is pivotally connected at opposite ends to the machine structure in a manner which will be described. The position of dancer bar 72 shown in FIGS. 1 and 2 corresponds to a condition of substantially no tension in the cloth. Increasing tension applied to the cloth will cause it to move in a direction away or outwardly from dancer bar chute 70 and into contact with dancer bar 72 moving or lifting bar 72 about its pivot axis. The amount of such movement of dancer bar 72 is proportional to the increase in tension applied to the cloth, and this is utilized by the control of the present invention in a manner which will be described.

Figure 3:
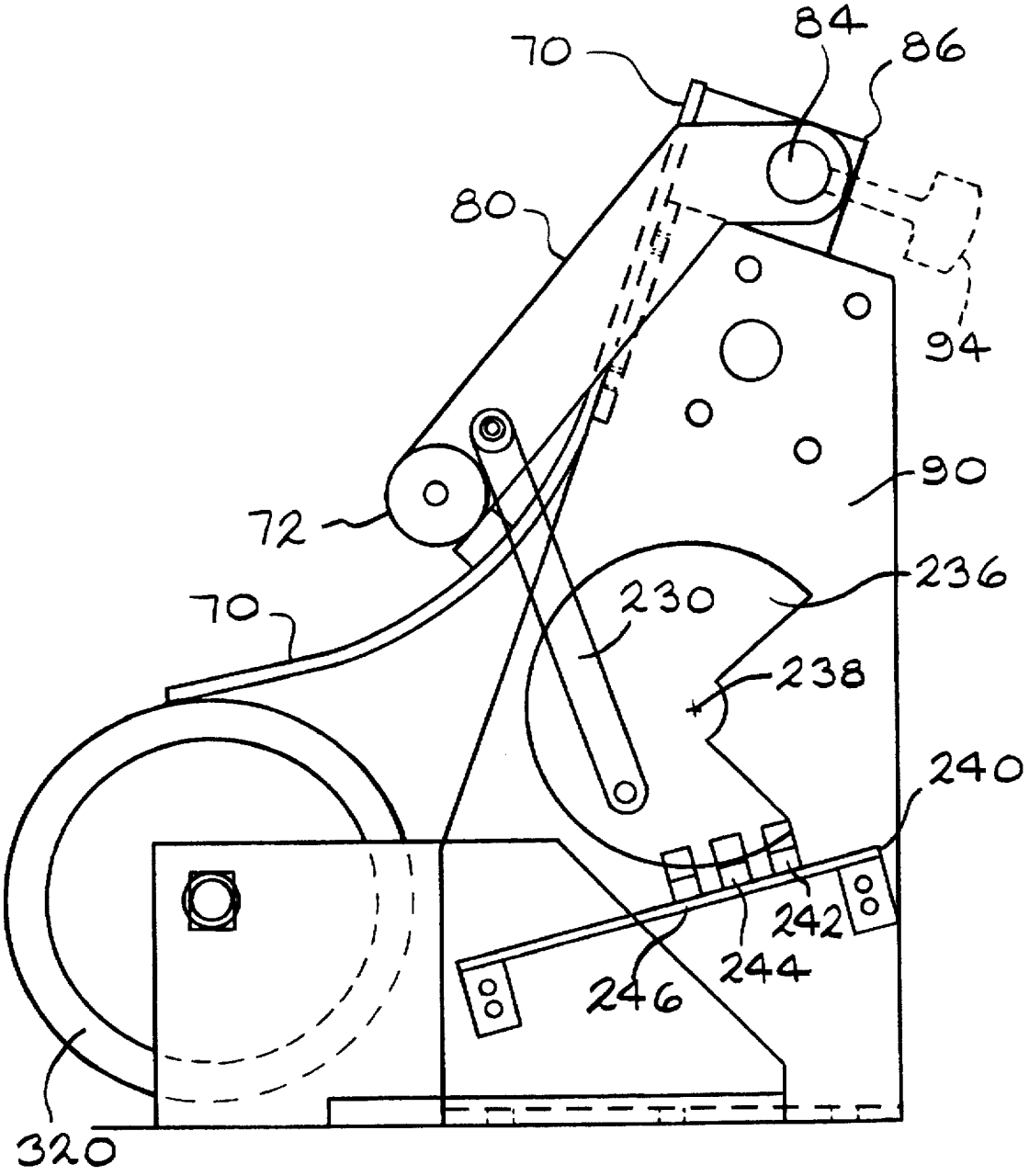
FIG. 3 is an enlarged fragmentary side elevational view of the dancer bar motion detector of the control in the machine of FIGS. 1 and 2.

Dancer bar 72 is in the form of a lightweight small diameter tube which extends laterally across machine 10 as shown in FIG. 1. It is connected at opposite ends to a pair of arms, one of which is designated 80 in FIG. 1 and which is shown in further detail in FIG. 3. Arm 80 is fixed at the lower end thereof to the corresponding end of dancer bar 72. Arm 80 is fixed at the upper end thereof to one end of a rod 84 which is rotatably supported in a block 86 which is fixed to dancer bar chute 70 which, in turn, is fixed to the upper end of bracket 90, the lower end of which is fixed to the machine frame 10. An identical arrangement of arm, rod, block and bracket is provided for the opposite end of dancer bar 72. A counter weight, indicated diagrammatically at 94 in FIG. 3, is fixed to rod 84 for the purpose of balancing dancer bar 72 and increasing its sensitivity to contact by the cloth when the tension on the cloth is increased.

After moving along dancer bar chute 70 the cloth next moves along a chute designated 100 in FIGS. 1 and 2 whereupon it enters a cloth engaging means such as a knife box designated 104 in FIG. 2. Knife box 104 is shown in lowered and raised positions relative to surface 16 in FIG. 2, the raising of knife box 104 being for the purpose of accommodating build-up of layers or plies of cloth as machine 10 traverses surface 16 in a known manner. A folding blade arrangement generally designated 108 in FIG. 1 is carried by machine frame 12 and raises and lowers in a manner similar to knife box 104 of FIG. 2 in a known manner. Both knife box 104 and folding blade arrangement 108 are conventional and well-known to those skilled in the art so that a detailed description thereof is believed to be unnecessary.

Chute 100 is a one-piece roll-up chute provided according to the present invention for accommodating raising of knife box 104 or folding blade arrangement 108 in a manner not interfering with movement of cloth along the chute 100 and will be described in further detail presently. A control panel 110 is carried by machine frame 12 and is provided with various selectors and indicators for use by a person operating machine 10.

Upon leaving cloth engaging means 104 or 108 the cloth moves into contact with the surface 16 of the table and is spread along surface 16 as machine 10 moves therealong. It is important that the speed of cradle motor 44 be synchronized with the speed of the machine drive motor so that the rate at which cloth is fed from roll 28 for spreading onto surface 16 is substantially equal to the speed of travel of machine 10 along surface 16. If machine 10 moves faster than cloth is unwound from roller 28 excess tension is applied to the cloth which can be undesirable or even harmful for some fabrics. If machine 10 moves slower than cloth is unwound from roller 28, excess slack is introduced to the cloth which also is undesirable.

In addition, it is the nature of such cloth spreading machines 10 to accelerate and decelerate during portions of the travel along surface 16. This can result in abruptly occurring differences between machine speed and cloth feed rate which suddenly can cause excess tension and slack conditions requiring immediate attention. Also, in providing synchronization between the speed of cradle motor 44 and the machine drive motor, there should be the capability of introducing, when desired, a controlled amount of tension to the cloth as it is unwound from roll 28.

In some types of cloth spreading machines it has been possible to provide a direct mechanical coupling between the machine drive and the drive for the cradle or other cloth feeding arrangement to provide the required synchronization. However, in other types of cloth spreading machines the cradle is mounted on a platform which is laterally movable on the machine frame to control the location of the edge of the cloth as it is being spread. Such platform structures render it very difficult and usually impossible to provide any mechanical coupling between the machine drive motor and the cradle motor.

Therefore, in accordance with the present invention there is provided an electrical control for synchronizing the speed of the cradle motor 44 with the machine drive motor to prevent undesired excess tension and slack in the cloth as machine 10 moves along surface 16, both at uniform speed and under conditions of acceleration and deceleration. The control is responsive to first and second signals proportional to the speed of travel of machine 10 and the rate at which cloth is unwound from roll 28, respectively, and the control provides a signal for controlling the speed of cradle motor 44 so that the rate at which cloth is unwound from roll 28 is substantially equal to the speed of travel of machine 10 along surface 16. This comprises one loop of the control. Sudden changes in tension applied to the cloth in response to acceleration and deceleration of machine 10 cause movement of dancer bar 72 which is converted by a transducer to another input to the control resulting in a relatively rapid compensating change in the signal for controlling the speed of cradle motor 44. This comprises another loop of the control.

Figure 4:
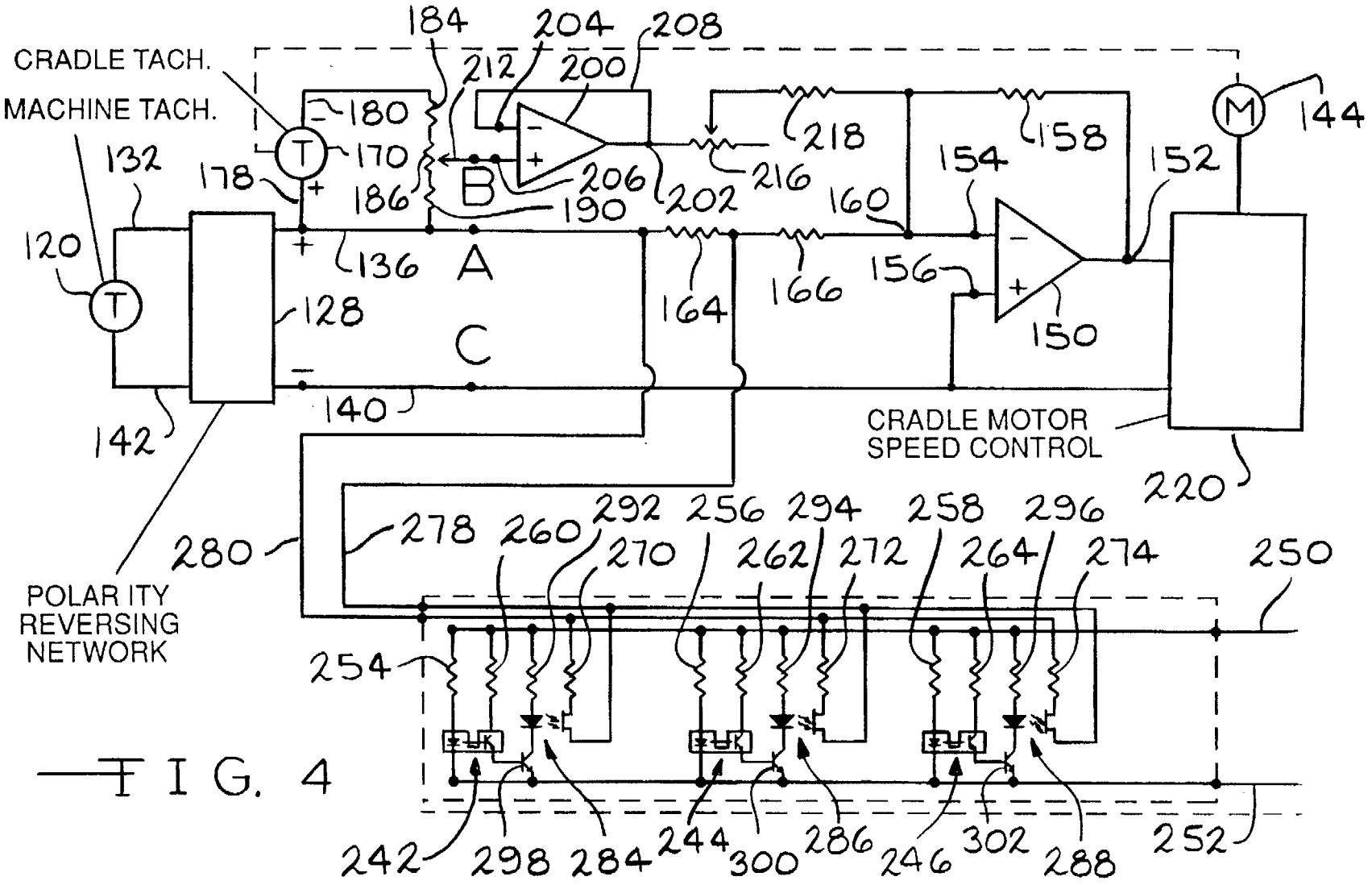
FIG. 4 is a schematic circuit diagram of the control of the present invention in the machine of FIGS. 1–3.

A circuit for providing the control according to the present invention is illustrated in FIG. 4. A tachometer 120 provides an output voltage proportional to the speed of the machine drive motor. Tachometer 120 is carried by machine frame 12 as shown in FIG. 2, and is drivenly coupled via a chain 122 and sprocket 124 to a shaft 126 of the drive arrangement for wheels 14. Thus, the output voltage of tachometer 120 is proportional to the rate of travel of machine 10 along surface 16. A polarity reversing network 128 is connected across the output of tachometer 120 to provide a constant polarity voltage regardless of the direction of movement of machine 10 along surface 16. In particular, the polarity of the output voltage of tachometer 120 reverses in response to change of direction of machine 10 along surface 16. Network 128 can have various forms which are known to those skilled in the art. By way of example, the positive or negative polarity output of tachometer 120 on line 132 is applied to the input of an amplifier which saturates very rapidly. The amplifier output is applied simultaneously to the bases of a pair of oppositely poled switching transistors, each connected between a supply voltage and the coil of a latching relay. Thus, depending upon the polarity of voltage on line 132 only one of the latching relays will be operated. One set of stationary contacts of the latching relay is connected to line 136 leading from network 128, and the other set of stationary contacts is connected to a common line 140 of the circuit. One switch arm of the latching relay is connected to line 142 from tachometer 120, and the other switch arm is connected to line 132. A voltage of the indicated polarity, and which remains at that polarity, appears across lines 136 and 140. Other known types of polarity reversing networks can of course be employed.

The circuit includes a first operational amplifier 150 having an output terminal 152, a negative input terminal 154 and a positive input terminal 156. Amplifier 150 is connected as a feedback amplifier by virtue of a feedback resistor 158 connected from the amplifier output to a summing node 160 connected to negative input 154. Positive input terminal 156 is connected to the circuit common or reference line 140. Line 136 leading from network 128 is connected through the series combination of resistors 164 and 166 to summing node 160. The magnitude of resistor 164 affects the gain of amplifier 150.

Another tachometer 170 provides an output voltage proportional to the speed of cradle motor 44. Tachometer 170 is carried by one of the cradle frames 130, 132 as shown in FIG. 2 and is drivenly coupled via a chain 172 and sprocket 174 to cradle motor 44. Thus, the output voltage of tachometer 170 is proportional to the speed of cradle motor 44 and thus to the rate at which cloth is unwound from roll 28. The polarity of the tachometer output voltage is indicated on lines 178 and 180. Line 178 is connected to line 136 leading from network 128. Line 180 is connected to one end of a voltage divider comprising the series combination of resistor 184, potentiometer 186 and resistor 190. The other end of the voltage divider, i.e. resistor 190, is connected to line 136.

The circuit includes a second operational amplifier 200 having an output 202, a negative input 204 and a positive input 206. Amplifier 200 is connected as a voltage follower by virtue of line 208 which connects output 202 directly to the negative input 204. The wiper arm 212 of potentiometer 186 is connected to positive input 206 of amplifier 200. The voltage divider comprising resistor 184, potentiometer 186 and resistor 190 applies a portion of the voltage output of tachometer 170 to amplifier 200 so that the voltages of tachometers 120 and 170 can be directly compared. Potentiometer 186 adjusts the magnitude of that portion in a manner introducing some tension, when desired, to the cloth being unwound from roll 28. The output 202 of amplifier 200 is applied through a potentiometer 216 and resistor 218 to the summing node 160 of amplifier 150. Potentiometer 216 affects the gain of amplifier 150 with respect to the difference between the machine and cradle tachometer voltages. The output 152 of amplifier 150 is applied to the input of speed control 220 for cradle motor 44. Speed control 220 is of the type including SCR circuits which is readily commercially available and well-known to those skilled in the art.

The voltage between points A and C in the circuit of FIG. 4 is a measure of the machine tachometer voltage, and the voltage between points B and A is a measure of the cradle tachometer voltage. The voltage between points B and C therefore is the difference between the machine and cradle tachometer voltages. This difference voltage plus the machine tachometer voltage are applied to the summing node 160 of amplifier 150. If the rate of unwinding of cloth from roll 28 is equal to the rate of travel of machine 10 along surface 16, manifested in the voltage B-A being equal to the voltage A-C, the difference voltage B-C is zero and the only voltage applied to summing node is the machine tachometer voltage A-C. The resulting output voltage from amplifier 150 applied to control 220 effects no change in the speed of cradle motor 44. On the other hand, if the rate of unwinding of cloth from roll 28 is less than the rate of travel of machine 10 along surface 16, the voltage B-A is less than the voltage A-C and this negative difference voltage B-C is applied to summing mode 160 along with machine tachometer voltage A-C causing an increase in the output voltage from amplifier 150 applied to speed control 220. This changes the firing angles of the SCRs in control 220 in a manner increasing the speed of motor 44. Likewise, if the rate of cloth from roll 28 is greater than the rate of travel of machine 10 along surface 16, the voltage B-A is greater than the voltage A-C and this positive difference voltage B-C is applied to summing node 160 along with machine tachometer voltage A-C causing a decrease in the output voltage from amplifier 150 applied to speed control 220. This changes the firing angles of the SCRs in control 220 in a manner decreasing the speed of motor.

The foregoing comprises one loop of the control of the present invention. It may be viewed as a negative feedback loop providing self-synchronization. This portion of the control synchronizes the rate of unwinding of cloth from roll 28 with the rate of travel of machine 10 along surface under conditions of constant velocity of machine 10. However, it is the nature of cloth spreading machines to accelerate or decelerate during portions of travel along cutting tables. Due to the inertia of the motors and tachometers, there can be a delay in the response of the control to sudden changes in cloth tension from such acceleration and deceleration. Accordingly, the control of the present invention includes a second loop which provides rapid change in the speed of cradle motor 44 to relieve cloth tension caused by machine acceleration and deceleration. Increased tension on the cloth moves dancer bar 72 to cause by transducer means progressive increases in resistance in parallel with resistor 164 so as to increase the gain of amplifier 150 rapidly thereby increasing the voltage applied to speed control 220 to increase the speed of cradle motor 44.

Referring first to FIG. 3, a link member 230 is pivotally connected at one end to arm 80 and pivotally connected at the opposite end to a substantially disc-shaped cam-like member 236 rotatably mounted at its center 238 to bracket 90. A circuit board 240 also mounted on bracket 90 carries a plurality, in the present illustration three, electro-optical switches 242, 244 and 246. Each switch comprises an LED and phototransistor on opposite sides of a gap. In the position of dancer bar 72 shown in FIG. 3, where there is little or no tension applied to the cloth which remains on or close to dancer bar chute 70, cam member 236 is in the gaps of all three switches blocking the path for light from each LED to its corresponding phototransistor. As a result, all three phototransistors are non-conducting. In the event that tension increases on the cloth being unwound from roll 28, the cloth moves away from dancer bar chute 70, i.e. to the left as viewed in FIG. 3, whereupon it contacts dancer bar 72 and moves or lifts it in a direction upwardly to the left as viewed in FIG. 3. This causes arm 80 to pivot about the axis of rod 84 and to pull link member 230 to the left as viewed in FIG. 3 rotating cam member 236 clockwise as viewed in FIG. 3. This removes cam member 236 sequentially from the gaps of switches 242, 244 and 246 to an extent depending upon the amount of tension applied to the cloth. Removal of cam member 236 from the transducer gap causes conduction of the phototransistor of that particular transducer. This is utilized to connect a resistance in parallel with resistor 164 to increase the gain of amplifier 150 thereby increasing the voltage applied to speed control 220 to increase the speed of cradle motor 44. The greater the tension applied to the cloth, the more dancer bar 72 moves to cause additional transistors to conduct to place more resistance in parallel with resistor 164 to further increase the gain of amplifier 150 to further increase the speed of cradle motor 44. Then, when machine decelerates, the opposite happens. The tension on the cloth decreases, dancer bar 72 returns to its initial or rest position near chute 70, cam member 236 sequentially blocks the gaps of the switches, resistance is removed in parallel with resistor 164 thereby reducing the gain of amplifier 150 to reduce the speed of cradle motor 44. The foregoing advantageously provides a relatively rapid response in the speed of cradle motor 44 when the tension applied to the cloth changes suddenly during acceleration and deceleration of machine 10.

The circuit for accomplishing the foregoing is shown in FIG. 4. The LEDs of the electro-optical switches 242, 244 and 246 are connected to bias voltage lines 250 and 252 through resistors 254, 256 and 258. The collectors of the phototransistors of switches 242, 244 and 246 are connected to bias voltage line 250 through resistors 260, 262 and 264. Conduction of the phototransistors is utilized to connect the resistors 270, 272 and 274 in parallel with resistor 164 via lines 278 and 280. The magnitude of resistor 270 is greater than that of resistor 272 which, in turn, in greater than that of resistor 274. Isolation between the circuit branch including those resistors and the supply lines 250 is provided by opto-isolators 284, 286 and 288. The photodiodes of the isolators are connected between supply lines 250, 252 via resistors 292, 294 and 296 and the collector-emitter paths of transistors 298, 300 and 302. The base terminals of these transistors are connected to the emitter terminals of the phototransistors of the transducers 242, 244 and 246. This arrangement enables the relatively low current switches 242, 244 and 246 to operate the relatively higher current isolators 284, 286 and 288.

By way of example, in an illustrative control circuit, tachometers 120 and 170 are commercially available from Servo-Tech under model no. SU-780D-1, amplifiers 150 and 200 are type VA747 or the equivalent, electro-optical switches 242, 244 and 246 are commercially available from Optek under model no. OPB848, electro-optical isolators 284, 286 and 288 are commercially available from Quality Technologies under model no. HF11F1 and motor control 220 is commercially available from Minarik under model no. RG300VA.

Resistor 158 has a magnitude of about 150K, resistors 164 and 166 have magnitudes of about 100K and 47K, respectively, resistor 184 has a magnitude of about 100K, potentiometer 186 is rated at 5K and resistor 190 has a magnitude of about 77K. Potentiometer 216 is rated at 100K and resistor 218 has a magnitude of about 150K. Resistors 270, 272 and 284 have magnitudes of about 470K, 330K and 220K, respectively. Each of resistors 254, 256 and 258 has a magnitude of about 1K, each of resistors 260, 262 and 2643 has a magnitude of about 22K, and each of resistors 292, 294 and 296 has a magnitude of about 470K.

Figure 5:
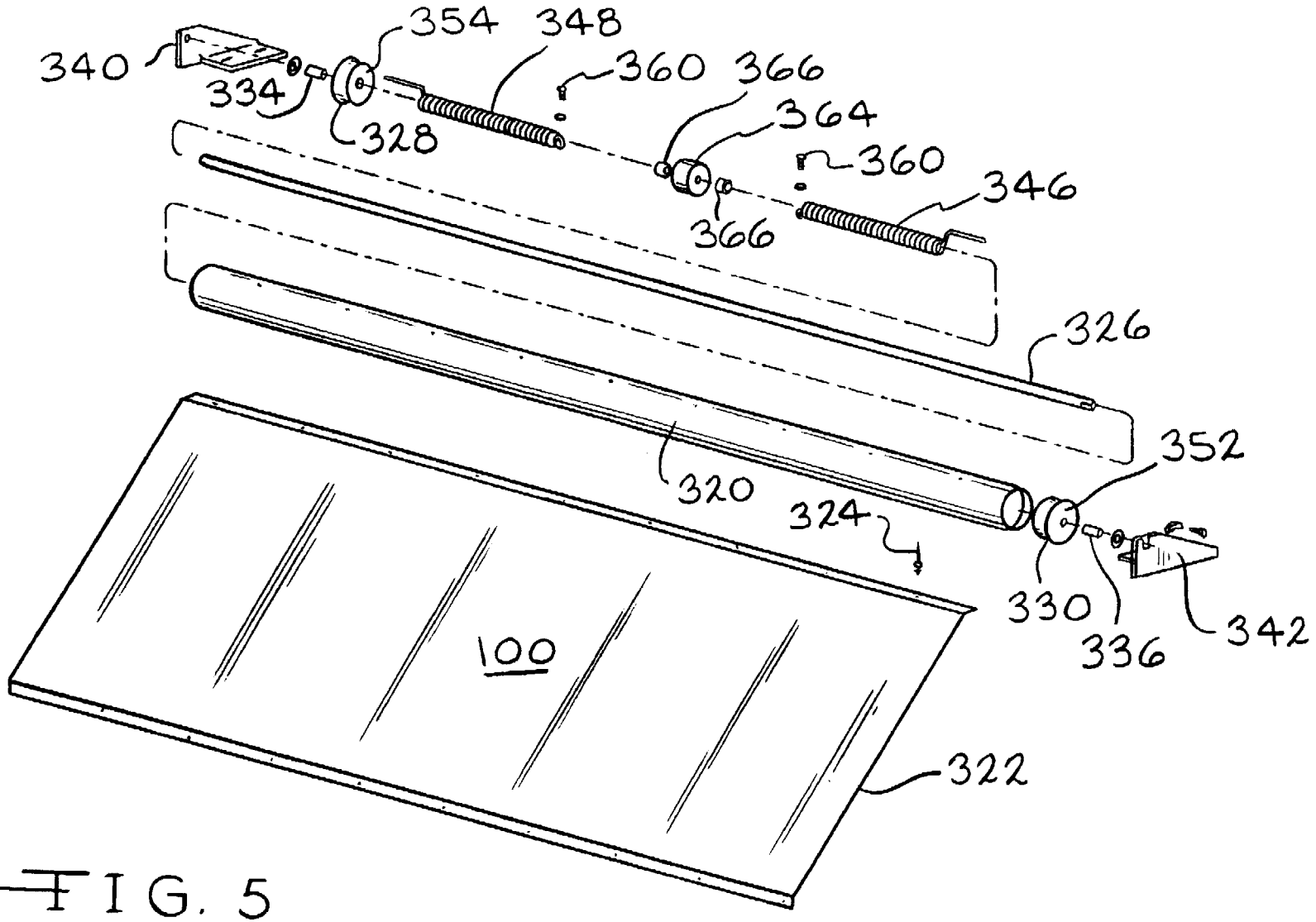
FIG. 5 is an exploded view of the roll-up chute of the cloth guide of the present invention in the machine of FIGS. 1 and 2.

As previously described, chute 100 is a one-piece roll-up chute according to the present invention for accommodating raising of knife box 104 or folding blades 108 in a manner not interfering with movement of cloth therealong. The one-piece sheet comprising chute 100 avoids pinching of cloth which can occur with two piece chutes previously provided to accommodate movement of knife boxes and folding blades in cloth spreading machines. Chute 100 is a one piece sheet 322 of relatively thin metal secured along one edge, i.e. the lower edge as viewed in FIGS. 1 and 2, to the cloth engaging means such as knife box 104 or folding blades 108 and secured along the opposite edge, i.e. the upper edge as viewed in FIGS. 1 and 2, to a spring-biased rotatably mounted tube 320. As shown in further detail in FIG. 5, the upper edge of sheet 322 is secured by fasteners 324 to the outer surface of hollow tube 320 through which a shaft 326 extends and is received at opposite ends in plugs 328, 330 which fit into opposite ends of tube 320. Plugs 328 and 330, in turn, are connected via bushings 334 and 336 to brackets 340 and 342, respectively, fixed to the machine frame 12. Left-hand and right-hand tension springs 346 and 348, respectively are placed on shaft 326 with the outer ends fitted into openings 352 and 354 in plugs 328 and 330, respectively, and with the inner ends fixed to shaft 326 by fasteners 360. A center bushing 364 with collars 366 fitted on the center portion of shaft 326 provides support for the same. Thus, raising of knife box 104 or folding blades 108 causes sheet 322 to wind around tube 320, this being assisted by the tension spring and shaft arrangement. When knife box 104 or folding blades 108 lowers, sheet 322 unwinds from tube 320, this also being assisted by the torsion springs.

It is therefore apparent that the present invention accomplishes its intended objects. The control shown and described in connection with FIG. 4 achieves synchronization of the cloth feed rate provided by the cradle with the speed of the machine along the surface so that unwinding of cloth from the roll is at substantially the same rate as the rate of travel of the machine along the surface. This is accomplished by a relatively simple control circuit which operates with standard electric motors used for the machine and cradle drives. Such synchronization is provided in a manner accommodating acceleration and deceleration in the travel of the machine and in a manner enabling some tension to be introduced to the fabric during unwinding if desired. Cloth is guided to the machine knife box or folding blades by the one piece rollup chute in a manner which effectively accommodates raising of the knife box or folding blades in response to build-up of plies of cloth on the surface and in a manner which does not interfere with smooth travel of the cloth through the machine.

While an embodiment of the present invention has been described in detail, that is for the purpose of illustration, not limitation.

What is claimed is:

1. In a cloth spreading machine having drive means for moving the machine along a surface for spreading cloth along the surface and a cradle for holding a roll of cloth and feeding cloth from the roll for spreading along the surface in response to operation of cradle motor means:

a) means for providing a first signal proportional to the speed of travel of said machine along the surface;

b) means for providing a second signal proportional to the rate of feed of cloth from the roll;

c) control means responsive to said first and second signals to provide a signal for controlling the speed of said cradle motor means so that the rate of feed of cloth from the roll is synchronized with the speed of travel of said machine along the surface;

d) electromechanical transducer means converting tension induced movement of the cloth during changes in speed of the machine into an electrical quantity utilized by said control means to change the speed of said cradle motor, said electromechanical transducer means comprising dancer bar means movably mounted on said machine and positioned to be moved in response to changes in tension applied to the cloth and position responsive means operatively associated with said dancer bar means for providing an electrical response to movement of said dancer bar means; and e) counter weight means operatively connected to said dancer bar means for balancing said dancer bar means to increase sensitivity of said dancer bar means to contact by said cloth when tension on said cloth is increased.

2. A cloth spreading machine according to claim 1, wherein said control means includes means for processing said first and second signals so that the rate of feed of cloth from the roll is substantially equal to the speed of travel of said machine along the surface.

3. A cloth spreading machine according to claim 1, wherein said control means includes feedback circuit means responsive to a difference between said first and second signals for causing an increase or decrease in the speed of said cradle motor means so that the rate of feed of cloth from the roll is substantially equal to the speed of travel of said machine along the surface.

4. A cloth spreading machine according to claim 3, wherein said feedback circuit means comprises:

a) an operational amplifier having an output and a pair of inputs, one of which is connected to a summing node;

b) feedback means connecting said amplifier output to said summing node;

c) circuit means for applying said first signal to said summing node; and d) circuit means for applying a difference between said first and second signals to said summing node.

5. A cloth spreading machine according to claim 1, wherein said control means includes adjustable means for affecting said signal for controlling cradle motor speed so as to introduce a preselected amount of tension to the cloth as it is unwound from the roll.

6. In cloth spreading machine having drive means for moving the machine along a surface for spreading cloth along the surface and a cradle for holding a roll of cloth and feeding cloth from the roll for spreading along the surface in response to operation of cradle motor means:

a) first tachometer means operatively connected to said machine drive means;

b) second tachometer means operatively connected to said cradle motor means;

c) first circuit means connected to said first and second tachometer means for providing a machine voltage signal proportional to the speed of said machine along the surface and a difference voltage signal proportional to the difference between the rate of feed of cloth from the roll and the speed of said machine along the surface;

d) feedback circuit means having an output and having a summing node at the input thereof;

e) second circuit means for applying said machine voltage signal and said difference voltage signal to said summing node;

f) motor speed control means operatively connected to said cradle motor means and having an input connected to said output of said feedback circuit means;

g) so that the speed of said cradle motor means is controlled to maintain the rate of feed of cloth from the roll substantially equal to the rate of travel of said machine along said surface; and h) a polarity reversing network connected between said first tachometer means and said first circuit means, said network being responsive to the voltage polarity output of said first tachometer means for providing a constant polarity voltage to said first circuit means regardless of the direction of movement of said machine along said surface.

7. A cloth spreading machine according to claim 6, wherein said first circuit means includes adjustable means for affecting said difference voltage signal to introduce a preselected amount of tension to the cloth as it is unwound from the roll.

8. A cloth spreading machine according to claim 6, further including electromechanical transducer means for converting tension induced movement of the cloth during changes in speed of the machine into an electrical quantity utilized by said feedback circuit means to change the speed of said cradle motor means.

9. A cloth spreading machine according to claim 8, wherein said electromechanical transducer means comprises dancer bar means movably mounted on said machine and positioned to be moved in response to changes in tension applied to the cloth and electro-optical means operatively associated with said dancer bar means for providing an electrical response to said feedback circuit means in proportion to the degree of movement of said dancer bar means.

10. A cloth spreading machine according to claim 6, wherein said feedback circuit means comprises an operational amplifier having an output and a pair of inputs, one of which is connected to said summing node, feedback resistance means connected between said output and said summing node, and gain-determining resistance means connected to one of the inputs thereof.

11. A cloth spreading machine according to claim 10, further including electromechanical transducer means for converting movement of the cloth due to increased tension of the cloth during acceleration of the machine into the addition of resistance in parallel with said gain-determining resistance means to increase the gain of said operational amplifier to cause an increase in the speed of cradle motor means.

12. A cloth spreading machine according to claim 11, wherein said electromechanical transducer means comprises dancer bar means movably mounted on said machine and positioned to be moved in response to an increase in tension applied to the cloth and electro-optical means operatively associated with said dancer bar means for switching resistance in parallel with said gain determining resistance means in proportion to the degree of movement of said dancer bar means.

13. In a cloth spreading machine having drive means for moving the machine along a surface for spreading cloth along the surface and a cradle for holding a roll of cloth and feeding cloth from the roll for spreading along the surface in response to operation of cradle motor means:

a) speed control means connected in controlling relation to said cradle motor means and having an input;

b) amplifier means having an output connected to the input of said speed control means and having an input;

c) circuit means for applying a voltage signal to said amplifier input to cause said speed control to operate said cradle motor means at a given speed, said circuit means including resistance means for controlling the gain of said amplifier;

d) electromechanical transducer means for converting movement of the cloth due to increased or decreased tension on the cloth during acceleration or deceleration, respectively, of the machine into addition or subtraction of resistance in parallel with said gain-controlling resistance to increase or decrease the gain of said amplifier to cause a compensating increase or decrease in the speed of said cradle motor means;

e) said electromechanical transducer means comprising dancer bar means movably mounted on said machine and positioned to be moved in response to a change in tension applied to the cloth and electro-optical transducer means operatively associated with said dancer bar means for switching resistant in parallel with said gain determining resistance means in proportion to the degree of movement of said dancer bar means; and f) said transducer means comprising a cam rotatably mounted on said machine, means for converting movement of said dancer bar means into rotation Of said cam, and a plurality of electro-optical switches each comprising an LED and a phototransistor on opposite sides of a gap, said cam being positioned initially in all of the gaps of said switches, said cam being moved in response to increasing tension on the cloth to sequentially leave the gaps of said switches to sequentially add resistance in parallel with said gain controlling resistance to increase the speed of said cradle motor means.

14. A cloth spreading machine according to claim 13, wherein said electromechanical transducer means comprises dancer bar means movably mounted on said machine and positioned to be moved in response to a change in tension applied to the cloth and electro-optical means operatively associated with said dancer bar means for switching resistance in parallel with said gain determining resistance means in proportion to the degree of movement of said dancer bar means.

15. In a cloth spreading machine including a frame movable along a surface for spreading cloth therealong from a roll of cloth carried by said machine and including cloth engaging means in the form of knife box means or folding blade means carried on said frame and movable away from said surface to accommodate build-up of plies of cloth spread on the surface, the improvement comprising:

one-piece roll-up chute means connected to said cloth engaging means and operatively connected to said machine frame for guiding cloth into said cloth engaging means in a manner accommodating movement of said cloth engaging means away from the surface.

16. A cloth spreading machine according to claim 15, wherein said one-piece roll-up chute means comprises a thin sheet fixed at one end to said cloth engaging means and fixed at the opposite end to tube means rotatably connected to said machine frame.

17. A cloth spreading machine according to claim 16, further including torsion spring means operatively associated with said tube means for assisting movement of said chute means.

* * * * *